US005569566A

United States Patent [19]

Kanayama et al.

[11] Patent Number: 5,569,566

[45] Date of Patent: Oct. 29, 1996

[54] PHOTORECEPTOR FOR ELECTROPHOTOGRAPHY WITH LOW FREE CHLORINE CONTENT POLYCARBONATE RESIN IN ORGANIC PHOTOCONDUCTIVE LAYER

[75] Inventors: Satoshi Kanayama, Kanagawa-ken; Noriyoshi Ogawa; Jun Tajima, both of Osaka, all of Japan

[73] Assignee: Mitsubishi Gas Chemical Company, Inc., Tokyo, Japan

[21] Appl. No.: 416,849

[22] PCT Filed: Sep. 13, 1994

[86] PCT No.: PCT/JP94/01511

§ 371 Date: Apr. 14, 1995

§ 102(e) Date: Apr. 14, 1995

[87] PCT Pub. No.: WO95/08138

PCT Pub. Date: Mar. 23, 1995

[30] Foreign Application Priority Data

Sep. 14, 1993 [JP] Japan ..... 5-229050

[51] Int. Cl.[6] ..... G03G 5/05

[52] U.S. Cl. ..... 430/58; 430/96

[58] Field of Search ..... 430/65, 67, 58, 430/59, 96

[56] References Cited

U.S. PATENT DOCUMENTS

| | | | |
|---|---|---|---|
| 4,315,063 | 2/1982 | Fukuda et al. | 430/64 |
| 5,139,908 | 8/1992 | Akasaki et al. | 430/58 |

FOREIGN PATENT DOCUMENTS

| | | |
|---|---|---|
| 0237953 | 9/1987 | European Pat. Off. . |
| 0234247 | 9/1987 | European Pat. Off. . |
| 59-71057 | 4/1984 | Japan . |
| 63-148263 | 6/1988 | Japan . |
| 63-170647 | 7/1988 | Japan . |
| 4-44048 | 2/1992 | Japan . |
| 6222582 | 8/1994 | Japan . |

OTHER PUBLICATIONS

Patent Abstract of Japan vol. 18 No. 600 (P–1826), 15 Nov., 1994 & JP–A–06 222582 (Fuji Xerox) 12 Aug. 1994.

*Primary Examiner*—John Goodrow

*Attorney, Agent, or Firm*—Sughrue, Mion, Zinn, Macpeak & Seas

[57] ABSTRACT

A photoreceptor for electrophotography which comprises a conductive substrate and a photoconductive layer on the conductive substrate, a polycarbonate resin containing free chlorine of 2 ppm or below being contained in the photoconductive layer. No minute black spots generate and an excellent quality of picture is provided.

4 Claims, No Drawings

PHOTORECEPTOR FOR ELECTROPHOTOGRAPHY WITH LOW FREE CHLORINE CONTENT POLYCARBONATE RESIN IN ORGANIC PHOTOCONDUCTIVE LAYER

TECHNICAL FIELD

The present invention relates to a photoreceptor for electrophotography, and more specifically, to a photoreceptor for electrophotography having a photoconductive layer containing a particular polycarbonate resin.

BACKGROUND ART

Now, electrophotographic arts are widely applied to copying machines and various printers owing to their high speed and high quality of picture.

Hitherto, as a photoreceptor for electrophotography in the electrophotographic arts, inorganic photoconductive materials including selenium, selenium/tellurium alloys, selenium/arsenic alloys, cadmium sulfide, etc., have been mainly used.

However, recently, from the standpoints of toxicity, safety, price, productivity, etc, photoreceptors for electrophtography used organic photoconductive materials have been developed.

When the organic photoconductive material is a low molecular substance, usually a coating film is formed by blending it with a binder resin. The binder resin for use includes various thermoplastic resins and thermosetting resins including vinyl polymers such as polymethylmethacrylate, polystyrene, polyvinyl chloride, etc., and copolymers thereof, polycarbonate, polyester, polysulfone, phenoxy resin, epoxy resin, silicone resin, etc. Among these various resins, polycarbonate resins are frequently used as the binder resin since they have comparatively excellent characteristics.

As examples using polycarbonate resins as a binder resin, for example, there are disclosed polycarbonate resin being derived from bisphenol Z in JP-A 59- 71057, polycarbonate resin being derived from bisphenol A in JP-A 63-170647, polycarbonate resin being derived from dimethylbisphenol A in JP-A 63-148263, and polycarbonate resin being derived from bisphenol AP in JP-A 4-44048, which are used as a binder resin.

However, although some photoreceptors for electrophotography obtained by using these known organic photoconductive materials and various binder resins are equivalent to those used inorganic photoconductive materials in sensitivity, etc., they are still insufficient in a quality of picture, etc., and have a problem of generation of minute black spots (pin holes), etc.

DISCLOSURE OF THE INVENTION

The object of the present invention is to provide a photoreceptor for electrophotography in which no minute black spots generate.

The present inventors have made extensive study to improve the above-mentioned drawbacks in a photoreceptor for electrophotography. As a result, a considerable proportion of chlorine was detected in the portion in which minute black spots generated.

It is considered that the chlorine has its origin in the contamination of phosgene or chlorine-containing organic solvents during synthesis of polycarbonate.

Since free chlorine of about 2 to 10 ppm is detected in conventional polycarbonates, the present inventors thought that there was some causality between free chlorine and minute black spots and found that a photoreceptor for photography able to remarkably inhibit generation of minute black spots could be obtained by using a particular polycarbonate resin as a binder resin. The present invention has been accomplished on the basis of above finding.

That is, the present invention provides a photoreceptor for electrophotography which comprises a conductive substrate and a photoconductive layer on the conductive substrate, a polycarbonate resin containing free chlorine of 2 ppm or below being contained in the photoconductive layer.

Moreover, the present invention provides a photoreceptor for electrophotography which comprises a conductive substrate and a charge generation layer and a charge transport layer on the conductive substrate, a polycarbonate resin containing free chlorine of 2 ppm or below being contained in the charge transport layer.

The present invention will be described in detail below.

The photoreceptor for electrophotography in the present invention has a photoconductive layer being composed of a charge generation material, a charge transport material, and a binder resin, if necessary, further having an undercoating layer, a protective layer, an adhesive layer, etc. The photoconductive layer is classified into a photoconductive layer being composed of a single layer containing a mixture of a charge generation material and a charge transport material and a laminate type of photoconductive layer having two layers of a charge generation layer generating a charge by exposure and a charge transport layer transporting a charge. Recently, a laminate type of photoreceptor for electrophotography has been mainly used. The polycarbonate resin in the present invention, particularly, is suitably used as a binder resin for a charge transport layer in a laminate type of photoreceptor for electrophotography having two layers.

The conductive substrate for use in the present invention includes metallic materials including aluminum, stainless steel, nickel, etc., or polyester films, phenol resins, papers, etc., provided with a conductive layer of aluminum, palladium, tin oxides, indium oxides, etc., on their surface.

The charge generation layer in the present invention is formed on a conductive layer by a well-known method. The charge generation layer for use, for example, includes organic pigments including azoxy-benzenes, bisazos, trisazos, benzimidazoles, polycyclicqunolines, indigoids, quinacridones, phthalocyanines, perylenes, methines, etc. The charge generation materials are used in the state dispersed their fine particles in a binder resin including polyvinylbutyral resin, polyvinylformal resin, silicone resin, polyamide resin, polyester resin, polystyrene resin, polycarbonate resin, polyvinyl acetate resin, polyurethane resin, phenoxy resin, epoxy resin, various celluloses.

The charge transport layer in the present invention is formed by dispersing a charge transport material in the polycarbonate according to the present invention as a binder resin by a well-known method.

The charge transport material, for example, includes polytetracyanoethylene; fluorenone compounds including 2, 4, 7-trinitro-9-fluorenone etc.; nitro compound including dinitroanthracene, etc.; succinic acid anhydride; maleic acid anhydride; dibromomaleic acid anhydride; triphenylmethane compounds; oxadiazole compounds including 2, 5-di(4-dimethylamino phenyl)-1, 3, 4-oxadiazole, etc.; styryl compounds including 9-(4-diethylaminostyryl) anthracene, etc.; carbazole compounds including poly-N-vinylcarbazole, etc.; pyrazoline compounds including 1-phenyl-3-(p-dimethylaminophenyl) pyrazoline, etc.; amine derivatives including 4, 4', 4" -tris (N, N,-diphenylamino) triphenylamine, etc.; conjugate unsaturated compounds including 1, 1-bis (4-diethylaminophenyl)-4, 4-diphenyl- 1, 3-butadiene, etc.; hydrazone compounds including 4-(N, N-diethylamino) benzaldehyde-N, N-diphenylhydrazone, etc.; nitrogen-containing cyclic compounds including indole compounds, oxazole compounds; isooxazole compounds, thiazole compounds, thiadiazole compounds, imidazole compounds, pyrazole compounds, pyrazoline compounds, triazole compounds, etc.; condensed polycyclic compounds, etc. The above-mentioned charge transport material is used alone or in the combination of at least two members.

The polycarbonate resin in the present invention can be produced by conventional interfacial polycondensation reaction between bisphenol and phosgene. The feature of the present invention is that purification is sufficiently conducted until a content free chlorine (existing almost in the form of sodium chloride or hydrogen chloride) containing in a solution of polycarbonate resin by-producing in the polycondensation reaction comes to be 2 ppm or below according to a colorimetry and a potentiometric titration method.

That is, an aqueous alkali solution is separated from a resin solution after polymerization and then neutralization purification based on at least three steps of water washing/an aqueous solution of phosphoric acid washing/water washing is conducted. Layer separation after washing in each step is conducted under a centrifugal force of 500G or above, and water washing in the final step is continued until a conductivity of water after centrifugal separation comes to be 5 μS/cm or below.

The water being used in the water washing is substantially non-free chlorine-containing ion exchanged water, which is easily obtainable by passing through a mixed phase containing a strong basic ion exchange resin and a strong acidic exchange reisn in the same amount to each other. Its free chlorine content is suitably 0.1 ppm or below which is a lower limit in quantitative analysis of chlorine according to existent colorimetry and potentiometric titration method.

The amount for use of water to a resin solution is in the range of 0.05 to 1.0 times by volume to 1 of a resin solution, and particularly, the amount in which water disperses in a resin solution in the state of emulsion is suitable. Moreover, it is important to conduct centrifugal separation under a centrifugal force of 500G or above, preferably 3000G or above. When a centrifugal force is small, water content in a resin solution increases, and it is required to repeat the operations of washing and centrifugal separation many times or even if the above-mentioned operations are repeated, it becomes difficult to make a conductivity of water 5 μS/cm or below. As a result, it is unpreferable because it becomes impossible to make a free chlorine content 2 ppm or below.

When a free chlorine content is above 2 ppm, in case of using a polycarbonate resin as a binder resin, minute black spots generate in a photoreceptor for electrophotography being thus obtained. Regarding the influence of the free chlorine on minute black spots, it is presumed that probably the free chlorine or an ion pair thereof will exert some bad influence on immigration mechanism of charge. Moreover, in certain cases, minute white spots generate in place of minute black spots, depending on charged conditions.

Since the polycarbonate resin in the present invention is used as a binder resin for formation of a photoconductive layer, a cast film forming process as a general photoconductive layer forming process should be applied. Therefore, from the standpoints of solution stability, solubility, layer formability and workability in formation of a layer, it is preferable that it is a polycarbonate resin being derived from bisphenol having a structure in which 10% (w/v) or above of the polycarbonate resin can be dissolved in a non-halogenated organic solvent. Thus, bisphenols as a raw monomer for production of polycarbonate having a structure so as to improve solubility, for example, include ortho-substituted bisphenols including 2, 2-bis (3, 5-dibromo- 4-hydroxyphenyl) propane (= tetrabromobisphenol A), 2, 2-bis (4-hydroxy-3-methylphenyl) propane, 1, 1-bis (3-t-butyl-4-hydroxyphenyl)propane, 2, 2-bis(4-hydroxy-3,5-dimethylphenyl)propane, 2, 2-bis(3-bromo-4-hydroxyphenyl)propane, 2, 2-bis(3,5-dichloro-4hydroxyphenyl-)propane, 2, 2-bis(3-phenyl-4hydroxyphenyl)propane, 2, 2-bis(3-cyclohexyl-4-hydroxyl) propane, etc.; bis(hydroxyaryl) arylalkanes including 1, 1-bis(4-hydroxyphenyl)-1-phenylethane, bis(4-hydroxyphenyl) diphenyl methane, etc.; at least one member selected from bis(hydroxylaryl-)cycloalkanes including 1, 1-bis(4-hydroxyphenyl)cyclopentane, 1, 1-bis( 4-hydroxyphenyl) cyclohexane, etc., or a combination of dihydroxydiarylethers including 4, 4'-dihydroxydiphenylether, 4, 4'-dihydroxy-3, 3'-dimethyldiphenylether, etc., and bis(hydroxyaryl) alkanes; a combination of dihydroxyldiarylsulfides including 4, 4'-dihydroxydiphenylsulfide, 4, 4'-dihydroxy-3, 3'-dimethyldiphenylsulfide, etc., and bis (hydroxyaryl) alkanes. Among them, particularly, at least one bisphenol selected from the group consisting of 2, 2-bis(4-hydroxy-3-methylphenyl)propane, 1, 1-bis( 4-hydroxyphenyl)-1-phenylethane, bis(4-hyroxyphenyl) diphenylmethane, 1, 1-bis(4-hydroxyphenyl) cyclohexane, a combination of 4, 4'-dihydroxydiphenylether and 2, 2-bis( 4-hydroxyphenyl) propane, and a combination of 4, 4'-dihydroxydipenylsulfide and 2, 2-bis (4-hydroxypenyl) propane are preferable.

The charge generation layer and the charge transport layer can be formed by coating a solution dissolved each the above-mentioned charge generation material or charge transport material together with a binder resin in a suitable solvent and drying.

The solvent, for example, includes aromatic solvents including benzene, toluene, xylene, etc., ketonic solvents including acetone, methylethylketone, cyclohexane, etc., halogen-containing solvents including methylene chloride, chloroform, carbon tetrachloride, ethylene chloride, tetrachloroethane, chlorobenzene, etc., ether solvents including tetrahydrofuran, dioxane, ethyleneglycoal diethylether, etc., ester solvents including methyl acetate, ethyl acetate, ethyl cellosolve, etc., alcohol solvents including methanol, ethanol, isopropanol, etc., dimethylformamide, dimethylsulfoxide, diethylformamide, etc. The solvent may be used alone or as a mixed solvent of the combination of at least two members.

Moreover, from enviromental problems in regulation for use of halogen-containing solvents, it is desirable to use a non-halogen-containing solvent as the solvent. Also regarding the binder resin, a binder resin dissoluble in a non-halogen-containing solvent is preferable. In case of forming a cast film, in order to efficiently ensure both thickness and surface flatness of a binder after molding, it is preferable that the binder resin has solubility of 10% (w/v) or more to a solvent.

The mixing ratio of a charge generation material to a binder resin is preferably in the range of 10:1 to 1:20. The thickness of the charge generation layer is 0.01 to 20 μm, preferably 0.1 to 2 μm.

The mixing ratio of a charge transport material to a binder resin is preferably in the range of of 10:1 to 1:10. The thickness of the charge transport layer is 2 to 100 μm, preferably 5 to 30 μm.

PREFERRED EMBODIMENTS OF THE INVENTION

The present invention will be explained in detail below, referring to Examples and Comparative Examples.

SYNTHESIS EXAMPLE 1

3.7 kg of sodium hydroxide was dissolved in 42 l of water, and further 8.5 kg of 1, 1-bis(4-hydroxyphenyl) cyclohexane (hereinafter, referred to as "BPZ") and 8 g of hydrosulfite were dissolved in the solution, while keeping the solution at 20 ° C. Then, 28 l of methylene chloride was added thereto and further 130 g of p-t-butylphenol (hereinafter, referred to as "PTBP" was added thereto with stirring. Then 4.0 kg of phosgene was fed therein over 60 minutes.

After feeding of phosgene, the reaction solution was emulsified with vigorous stirring, and thereafter 8 g of triethylamine was added thereto and the emulsion was stirred for about one hour to conduct polymerization.

After completion of polymerization, the resulting polymerization solution was fed to a continuous type of centrifuge separator to separate the water phase under a centrifugal force of 5,000G. The resin solution was fed to a stirring vessel and 20 l of pure water was added thereto to stir for 30 minutes. After stirring has finished, the water phase was centrifuged in the same manner. The thus obtained resin solution was fed to a phosphoric acid neutralization vessel and further 20 l of 1% an aqueous solution of phosphoric acid was added with stirring. After stirring has finished, the aqueous solution of phosphoric acid was centrifuged in the same manner. Then, the resin solution was fed to a washing vessel and 20 l of pure water was added thereto to stir. Centrifugal separation was repeated until a conductivity of water came to be 5 μS/cm or below. The conductivity of finally separated water phase was 4.4 μS/cm. 35 l of isopropanol was added to the resin solution to precipitate a polymer. The precipitation was filtered and then dried, whereby a powdery polycarbonate resin having a limiting viscosity of 0.49 and a free chlorine content of 1.7 ppm (hereinalter, referred as to "P-1") was obtained.

SYNTHESIS EXAMPLE 2

Synthesis was conducted in the same manner as in Synthesis Example 1 except that 9.15 kg of 1, 1-his (4-hydroxyphenyl)-1-phenylethane (hereinafter, referred as to "BPAP") was used in place of 8.5 kg of BPZ.

The conductivity of finally separated water phase in the washing step was 3.5 μS/cm.

The chloride content of the thus obtained powdery polycarbonate resin (hereinafter, referred as to "P-2") was 1.2 ppm.

SYNTHESIS EXAMPLE 3

Synthesis was conducted in the same manner as in Synthesis Example 1 except that 4.58 kg of BPAP and 4.06 kg of 2, 2-bis(3-methyl-4-hydroxyphenyl)propane were used in place oi 8.5 kg of BPZ.

The conductivity of finally separated water phase was 3.9 μS/cm.

The chlorine content of the thus obtained polycarbonate resin (hereinafter, referred as to "P-3") was 1.1 ppm.

SYNTHESIS EXAMPLE 4

Synthesis was conducted in the same manner as in Synthesis Example 1 except that water washing was continued until the conductivity of finally separated water phase in the washing step came to be 12.7 μS/cm.

The chlorine content of the thus obtained powdery polycarbonate resin (hereinalter, referred as to "P-4") was 6.3 ppm.

SYNTHESIS EXAMPLE 5

Synthesis was conducted in the same manner as in Synthesis Example 1 except that centrifugal separation was conducted under 450G to conduct purification. The conductivity of finally separated water in the washing step was 5.3 μS/cm, but the resin solution was more opaque and clearly in the state of more insufficient separation than that in Synthesis Example 1.

The chlorine content of the thus obtained powdery polycarbonate resin (hereinalter, referred as to "P-5") was 2.6 ppm.

EXAMPLE 1

10 parts of τ type of copper phthalocyanine, 5 parts of phenoxy resin, 5 parts of polyvinylbutyral resin and 100 parts of dimethoxyethane were mixed and then pulverization and dispersion treatments were conducted thereof by a sand grind mill, whereby a coating solution was prepared. The coating solution was coated on a polyethyleneterephthalate film vapor-deposited aluminum in a thickness of about 50 nm and dried, whereby a charge generation layer having a thickness of about 0.5 μm was provided thereon. Then, a coating solution was further prepared by using 50 parts of 4-(N,N-diethylamino)benzaldehyde-N,N-diphenylhydrazone, 50 parts of polycarbonate resin P-1 obtained in Synthesis Example 1 and 350 parts of tetrahydrofuran. The coating solution was coated on the above-mentioned charge generation layer and dried to provide a charge transport layer having a thickness of about 20 μm, whereby a laminate type of photoreceptor for electrophotography was prepared.

Evaluation for the photoreceptor for electrophotography was conducted as follows. An A4 size sheet of white manuscript was copied by using a blade-cleaning type of copying machine available on the market having a scorotron charging appliance. Generation status of minute black spots (a diameter of about 100 μm to 500 μm) was observed with the eye for the thus obtained copy. The result is shown in table 1.

EXAMPLES 2 AND 3, COMPARATIVE EXAMPLES 1 AND 2

Evaluation was conducted in the same manner as in Example 1 by using each polycarbonate resin shown in table 1. The results are shown in table 1.

P-1: Poylcarbonate resin obtained in Synthesis Example 1

P-2: Poylcarbonate resin obtained in Synthesis Example 2

P-3: Poylcarbonate resin obtained in Synthesis Example 3

P-4: Poylcarbonate resin obtained in Synthesis Example 4

P-5: Poylcarbonate resin obtained in Synthesis Example 5

Free Chlorine Content

Potentiometric titration apparatus using a 0.0005M acetone solution of silver nitrate as a titration indicator (made by Hiranuma Sangyo, k. k, Japan; Hiranuma reporting titrator, COMTITE-7).

TABLE 1

| | Polycarbonate | Free chlorine | Numbers of minute black spots |
|---|---|---|---|
| Example 1 | P-1 | 1.7 ppm | 0 |
| Example 2 | P-2 | 1.2 ppm | 0 |
| Example 3 | P-3 | 1.1 ppm | 0 |
| Comp.Ex 1 | P-4 | 6.3 ppm | 10 |
| Comp.Ex 2 | P-5 | 2.6 ppm | 2 |

INDUSTRIAL APPLICABILITY

The photoreceptor for electrophotography according to the present invention in which a polycarbonate resin containing free chlorine of 2 ppm or below is used as a binder resin in a photoconductive layer can inhibit generation of minute black spots (pin holes). Moreover, the polycarbonate resin in the present invention has good solubility for non-halogen-containing conventional solvents, so that solution stability, solubility, film formability, workability etc., are improved in case of preparing a photoreceptor for electrophotography.

We claim:

1. A photoreceptor for electrophotography which comprises a conductive substrate and a photoconductive layer on the conductive substrate, a polycarbonate resin containing free chlorine of 2 ppm or below being contained in the photoconductive layer.

2. A photoreceptor for electrophotography according to claim 1, wherein the polycarbonate resin has a structure in which 10% (w/v) or above of the polycarbonate resin can be dissolved in a non-halogen-containing organic solvent.

3. A photoreceptor for electrophotography according to claim 1, wherein the polycarbonate resin comprises at least one hisphenol selected from the group consisting of 2, 2-bis(4-hydroxy-3-methylphenyl) propane, 1,1-bis(4-hydroxyphenyl)-1-phenylethane, bis (4-hydroxyphenyl) diphenylmethane and 1, 1-bis(4-hydroxyphenyl)cyclohexane, a mixture of 4, 4'-dihydroxydiphenylether and 2, 2-bis(4-hydroxyphenyl) propane or a mixture of 4, 4'-dihydroxyldiphenylsulfide and 2, 2-bis (4-hydroxylphenyl) propane.

4. A photoreceptor for electrophotography which comprises a conductive substrate and a charge generation layer and a charge transport layer on the conductive substrate, a polycarbonate resin containing free chlorine of 2 ppm or below being contained in the charge transport layer.

* * * * *